US007553212B2

(12) United States Patent
Yamaguchi

(10) Patent No.: US 7,553,212 B2
(45) Date of Patent: Jun. 30, 2009

(54) AUTOMOBILE MODEL

(75) Inventor: Takashi Yamaguchi, Tokyo (JP)

(73) Assignee: Konami Digital Entertainment Co., Ltd., Tokyo (JP)

( * ) Notice: Subject to any disclaimer, the term of this patent is extended or adjusted under 35 U.S.C. 154(b) by 164 days.

(21) Appl. No.: 10/511,919

(22) PCT Filed: Apr. 16, 2003

(86) PCT No.: PCT/JP03/04795

§ 371 (c)(1),
(2), (4) Date: Feb. 17, 2005

(87) PCT Pub. No.: WO03/086561

PCT Pub. Date: Oct. 23, 2003

(65) Prior Publication Data

US 2005/0140109 A1 Jun. 30, 2005

(30) Foreign Application Priority Data

Apr. 18, 2002 (JP) ..... 2002-116800

(51) Int. Cl.
*A63H 17/36* (2006.01)

(52) U.S. Cl. ..... 446/460; 446/469; 446/468

(58) Field of Classification Search ..... 446/469, 446/437, 456, 454, 468
See application file for complete search history.

(56) References Cited

U.S. PATENT DOCUMENTS

| | | | | |
|---|---|---|---|---|
| 3,510,981 | A * | 5/1970 | La Branche et al. | 446/444 |
| 3,608,236 | A | 9/1971 | Beny et al. | |
| 4,508,516 | A * | 4/1985 | D'Andrade et al. | 446/443 |
| 5,281,184 | A * | 1/1994 | Suimon | 446/460 |
| 5,762,533 | A * | 6/1998 | Tilbor et al. | 446/466 |
| 5,775,972 | A * | 7/1998 | Siu | 446/468 |
| 6,024,627 | A * | 2/2000 | Tilbor et al. | 446/456 |
| 6,231,422 | B1 * | 5/2001 | Choi | 446/444 |
| 6,394,878 | B1 * | 5/2002 | Wang | 446/469 |
| 6,540,583 | B1 * | 4/2003 | Hoeting et al. | 446/431 |
| 6,604,982 | B1 * | 8/2003 | Croteau-Brooks | 446/466 |
| 6,945,843 | B1 * | 9/2005 | Motosko | 446/437 |
| 7,121,916 | B2 * | 10/2006 | Suimon et al. | 446/469 |

FOREIGN PATENT DOCUMENTS

| | | |
|---|---|---|
| FR | 2 443 263 A | 7/1980 |
| JP | 61-2632 Y2 | 1/1986 |
| JP | 03-24239 Y2 | 5/1991 |
| WO | 96/12539 A1 | 5/1996 |

* cited by examiner

*Primary Examiner*—Gene Kim
*Assistant Examiner*—Urszula M Cegielnik
(74) *Attorney, Agent, or Firm*—Darby & Darby PC

(57) ABSTRACT

An automobile model comprising a pair of left and right rear wheels 21 which are independently driven by different motors 24, a pair of left and right front wheels 22, and a front wheel-supporting mechanism 30 which supports the front wheels 22 such that each front wheel 22 can turn around a predetermined steering axis AX and such that the front wheels 22 can turn in the same direction in association with each other, wherein the steering axis AX is inclined with respect to a vertical direction such that an upper portion of the steering axis AX is located rearward of a lower portion of the steering axis AX in a traveling direction.

8 Claims, 4 Drawing Sheets

AUTOMOBILE MODEL

CROSS-REFERENCE TO PRIOR APPLICATION

This is a U.S. national phase application under 35 U.S.C. §371 of International Patent Application No. PCT/JP03/04795 filed Apr. 16, 2003, and claims the benefit of Japanese Patent Application No. 2002-116800 filed Apr. 18, 2002 which is incorporated by reference herein. The International Application was published in Japanese on Oct. 23, 2003 as WO 03/086561 A1 under PCT Article 21(2).

TECHNICAL FIELD OF THE INVENTION

The present invention relates to an automobile model which turns by generating a speed difference between a pair of left and right driven wheels.

BACKGROUND OF THE INVENTION

Turning motion of a remotely controlled automobile model is generally realized by driving a steering servomotor mounted in the automobile model in accordance with an operation amount of a steering section of a transmitter operated by a user. In a small automobile model, however, it is difficult, in some cases, to secure a space for accommodating the steering servomotor in the vicinity of steered wheels. Accordingly, there exist a small automobile model in which the turning motion is realized by generating a speed difference between the pair of left and right driven wheels.

Incidentally, in the automobile model which realizes the turning motion by the speed difference between the driven wheels, since a mechanism for positively operating the steered wheels is not provided, the steered wheels are fixed in a straight-ahead driving state and are mounted on a vehicle body, thereby preventing fluctuation of the vehicle in a traveling direction caused by irregular behavior of the steered wheels.

However, in the case that the steered wheels are fixed in the straight-ahead driving state, since the attitude of the steered wheels is not varied even during the turning motion, reality becomes chipped, and interest of a model may be reduced. Since a reaction force in a direction in which the vehicle is forced to travel straightly is applied from a road surface to the steered wheels which are fixed in the straight-ahead driving state, the turning motion is not carried out smoothly in some cases.

SUMMARY OF THE INVENTION

Therefore, the present invention aims to provide an automobile model capable of realizing a stable turning motion by naturally steering the steered wheels in the traveling direction without providing a steering driving source, even if the automobile model is of a structure in which the turning motion is carried out by the speed difference between the driven wheels.

According to an embodiment of the present invention, an automobile model is provided with a pair of left and right driven wheels which are independently driven by different driving sources, a pair of left and right steered wheels, and a steered wheel-supporting mechanism which supports the steered wheels such that each steered wheel can turn around a predetermined steering axis and such that the steered wheels can turn in the same direction in association with each other. The steering axis is inclined with respect to a vertical direction such that an upper portion of the steering axis is located rearward of a lower portion of the steering axis in a traveling direction.

According to another embodiment of the present invention, when the speed difference is generated between the driven wheels to turn the automobile model, the steered wheels are naturally steered in the turning direction by a reaction force received from the ground-contact surface. Further, since the steering axis of the steered wheel is inclined as described above and a caster angle in a so-called positive direction is set in the steering axis, resiliency in the straight-ahead driving state is applied to the steered wheels which are being turned. This resiliency functions as a force which suppresses the excessive turning motion of the steered wheels, so that the attitude of the steered wheels during the turning motion can be stabilized. Further, since the left and right steered wheels are associated with each other such that they are steered in the same direction in association with each other, there is no adverse possibility that the steered wheels are steered in the different directions from each other and thus the traveling direction of the automobile model is disturbed.

In the automobile model according to an embodiment of the present invention, it is preferable that an inclination angle of the steering axis with respect to the vertical direction is set in a range of 20° to 40°. If the inclination angle is less than 20°, there is an adverse possibility that the resiliency toward the straight-ahead driving state is insufficient and the effect for stabilizing the turning attitude cannot be exhibited sufficiently, while if the inclination angle exceeds 40°, there is an adverse possibility that the resiliency is excessively strong and natural turning motion of the steered wheels cannot be obtained.

The steered wheel-supporting mechanism may support the steered wheels such that center lines of the steered wheels as viewed from directly above in a straight-ahead driving state are inclined with respect to the traveling direction. Therefore, a so-called tow angle is applied to the steered wheels. The steered wheel-supporting mechanism may support the steered wheels such that center lines of the steered wheels as viewed from front in the traveling direction in a straight-ahead driving state are inclined with respect to the vertical direction. In this case, a so-called camber angle is applied to the steered wheels.

Further, the steered wheel-supporting mechanism may support the steered wheels such that the left and right steered wheels can incline in the same direction in association with each other as viewed from front in the traveling direction. By carrying out such support, the steered wheels can integrally be inclined in accordance with a turning radius, and the adhesion of the steered wheels is enhanced.

BEST MODE FOR CARRYING OUT THE INVENTION

Figure 1:
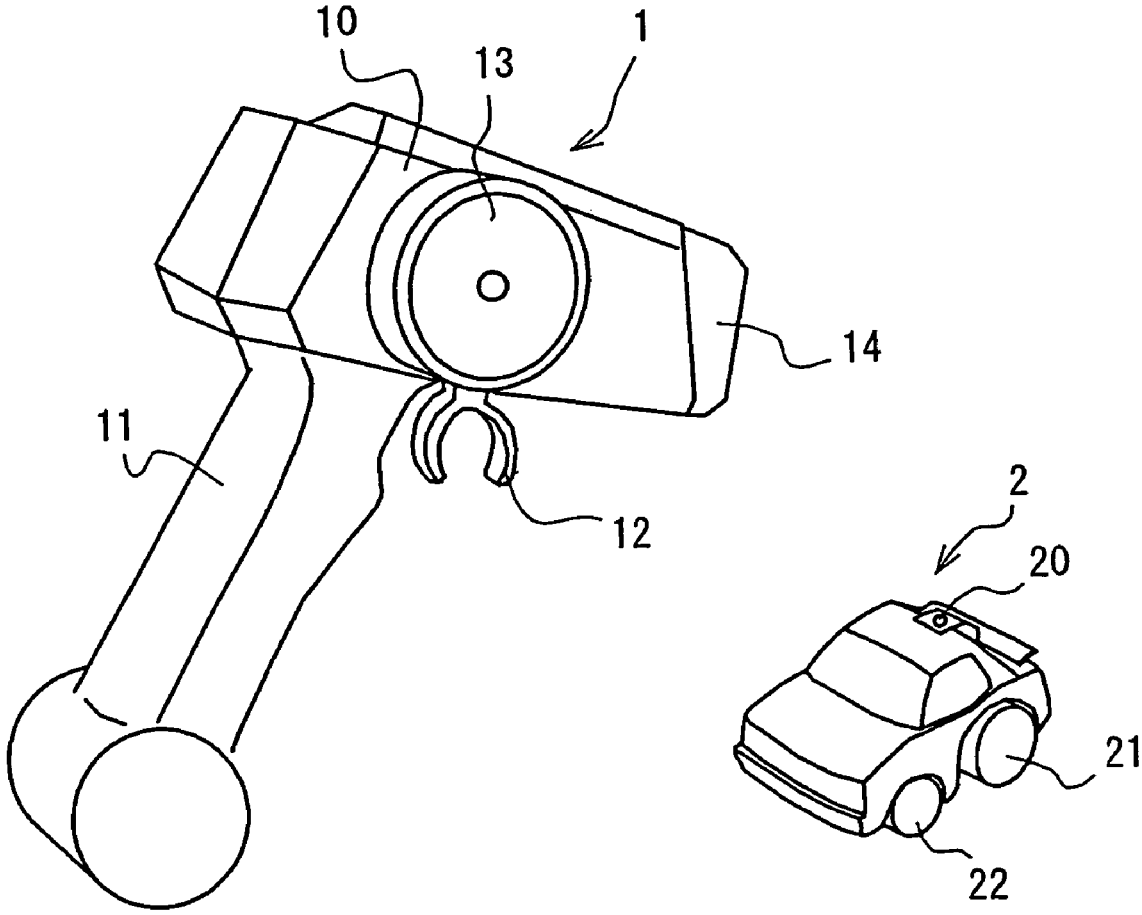
FIG. 1 is a view showing a structure of a remotely controlled toy according to an embodiment of the present invention.

FIG. 1 shows a remotely controlled toy to which the present invention is applied. This remotely controlled toy includes a controller 1 operated by a user, and an automobile model 2 whose motion is controlled based on control data sent from the controller 1. The controller 1 includes a body 10 and a grip 11 grasped by the user, and a trigger lever 12 for instructing the speed is provided in front of the grip 11 such that the trigger lever 12 can move in its longitudinal direction. The body 10 is provided at its right side surface with a steering operation wheel 13 such that the wheel 13 can rotate around its center. A control device (not shown) for generating the control data in accordance with the operated states of the trigger lever 12 and the wheel 13 is provided in the controller 1. As one example, the control device determines a basic driving speed of the model 2 in accordance with the operation amount of the trigger lever 12, determines a speed reduction ratio of one of left and right driven wheels with respect to the driving speed in accordance with the operation direction and the operation amount of the wheel 13, and individually determines the driving speeds of the left and right driven wheels based on these determinations. The control data includes information for individually instructing the driving speeds of the left and right driven wheels, and the control data is sent from a transmitting section 14.

The automobile model 2 includes a receiving section 20 for receiving the control data from the controller 1, a pair of left and right rear wheels 21 as the driven wheels, and a pair of left and right front wheels 22 as the steered wheels. In FIG. 1, only one of the rear wheels 21 and one of the front wheels 22 are shown.

Figure 2:
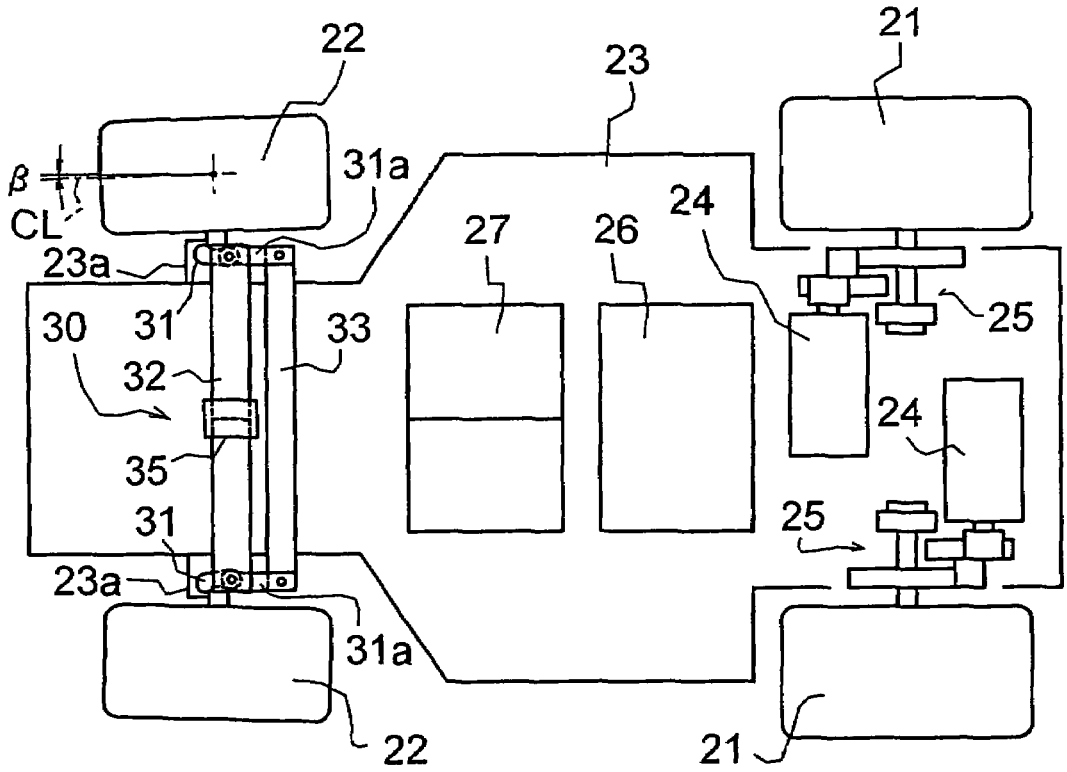
FIG. 2 is a diagram of a configuration on a chassis of an automobile model shown in FIG. 1.

FIG. 2 shows an interior structure of the automobile model 2. The automobile model 2 includes a chassis 23, and, on the chassis 23, there are mounted motors 24 and 24 as driving sources for independently driving the rear wheels 21 and speed reduction mechanism 25 and 25 for respectively transmitting rotations of the motors 24 and 24 to the corresponding rear wheels 21. A control device 26 and a rechargeable battery 27 are provided in front of the motors 24 and 24. The control device 26 decodes the control data received by the receiving section 20, and controls and drives the motors 24 and 24 at the speed designated by the control data. According to such control, if the wheel 13 is rotated from the neutral position, a speed difference is generated between the rear wheels 21 at a degree corresponding to the operation direction and the operation amount, and the automobile model 2 turns in accordance with the speed difference. A relation between the operations of the trigger lever 12 and the wheel 13 of the controller 1, and the speed difference generated between the motors 24 and 24 can appropriately be changed, and details thereof are not subject matters of the present invention, so that the explanation thereof are omitted.

Figure 3:
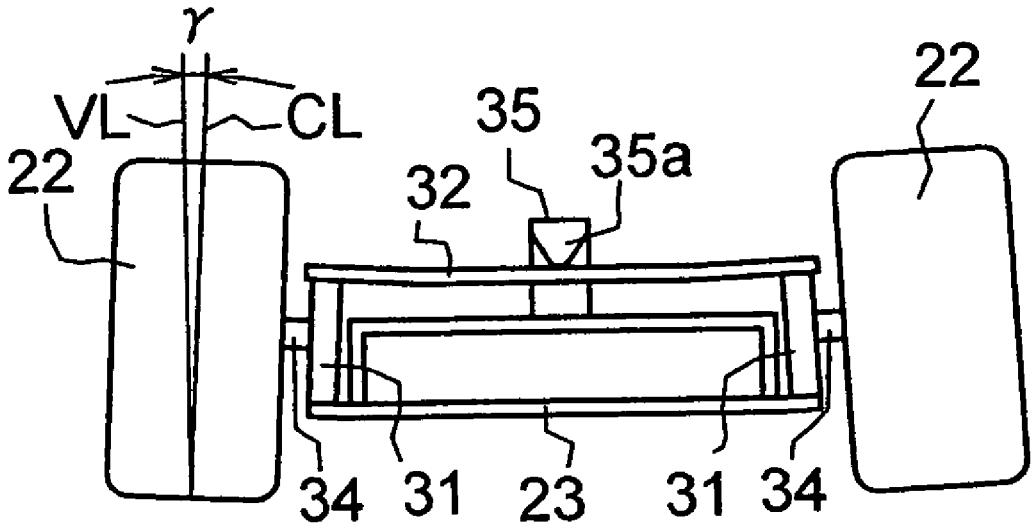
FIG. 3 is a sectional view of a front wheel-supporting mechanism shown in FIG. 2 taken along a direction of an axle.

As shown in FIGS. 2 and 3, the chassis 23 of the automobile model 2 is provided with a front wheel-supporting mechanism 30. The front wheel-supporting mechanism 30 includes king pins 31 and 31, a rod 32 for connecting upper ends of the king pins 31 and 31 with each other, and a rod 33 for connecting arms 31*a* and 31*a* (see FIG. 4) projecting from the king pins 31 and 31 rearward.

Figure 4:
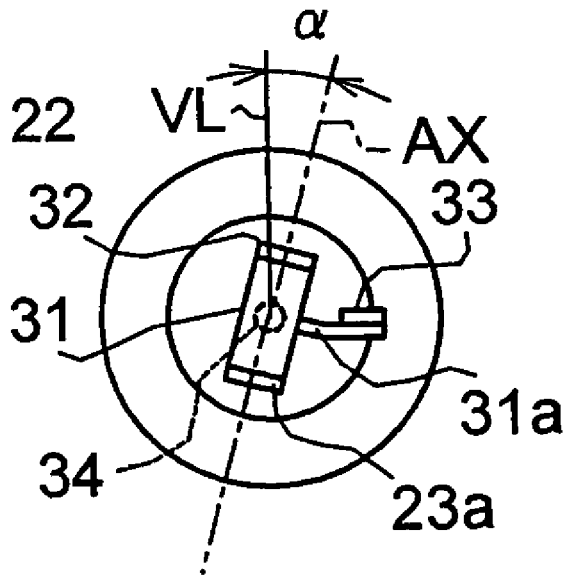
FIG. 4 is a view showing a relation between a front wheel and a king pin as viewed from inside of the front wheel.

As shown in FIG. 4, the king pin 31 extends along a predetermined axis AX, and the king pin 31 is integrally provided with an axle 34 which projects in a direction perpendicular to the axis AX. The front wheels 22 are rotatably supported by the axle 34. Lower ends of the king pins 31 are rotatably supported by bearings 23*a* and 23*a* of the chassis 23, while upper ends of the king pins 31 are rotatably connected to the rod 32. The rod 32 is rotatably connected at its opposite ends to the upper ends of the king pins 31, and a central portion thereof is inserted into a restraining section 35 of the chassis 23 to be restrained such that the rod 32 cannot move in the longitudinal direction (traveling direction). A reversed-triangular supporting section 35*a*, which comes in line-contact with a central portion of an upper surface of the rod 32, is formed in the restraining section 35. The supporting section 35*a* receives reaction forces which are input to the front wheels 22. Since the support of the front wheels 22 is limited to one portion of the supporting section 35*a*, the rod 32 can laterally rock around the supporting section 35*a*. And then, since the rod 32 and the front wheels 22 are connected to each other through the king pins 31 and 31, the left and right front wheels 22 are inclined in the same direction in association with each other through the rod 32. Since the front wheels 22 are supported in this manner, the adhesion of the front wheels 22 at the time of turning motion is enhanced.

The restraining section 35 restrains the rod 32 at a position deviated rearward in the traveling direction as compared with a connection point between the king pin 31 and the bearing 23*a*. Therefore, the axis AX of the king pin 31 is inclined with respect to a vertical line VL such that an upper portion of the axis AX is located rearward of its lower portion in the straight-ahead direction. The axis AX is a steering axis which functions as a center of turning motion of the front wheel 22, and an angle $\alpha$ formed between the steering axis AX and the vertical line VL is referred to as a caster angle. The caster angle $\alpha$ is preferably in a range of 5° to 40°, and more preferably in a range of 10° to 15°.

Further, the king pins 31 and 31 are associated with each other by the rod 33 such that they always turn in the same direction. In a general automobile model, such a rod is driven by a servomotor to steer the front wheels. However, in the automobile model 2 of this embodiment, there is no driving source which drives the rod 33 to steer the front wheels 22. And then, the king pins 31 can freely turn by a force which is input from the front wheels 22 while keeping the association relation established by the rod 33.

In the automobile model 2 having the above-described structure, when the rear wheels 21 are allowed to generate a speed difference to turn the automobile model 2, the front wheels 22 are naturally steered in a turning direction by reaction forces received from a grounding surface. That is, the front wheels 22 are steered passively. Since a positive caster angle $\alpha$ is set in each front wheel 22, a resiliency toward the straight-ahead driving state is applied to each of the front wheels 22 which are being turned. Thus, over-turning motions of the front wheels 22 are prevented, and the steering attitude becomes stable. Further, since the left and right front wheels 22 are associated with each other by the rod 33 so as to be steered in the same direction in an interlocked manner, there is no adverse possibility that the front wheels 22 are steered in different directions from each other and that the traveling direction of the automobile model 2 is disturbed.

Figure 5A:
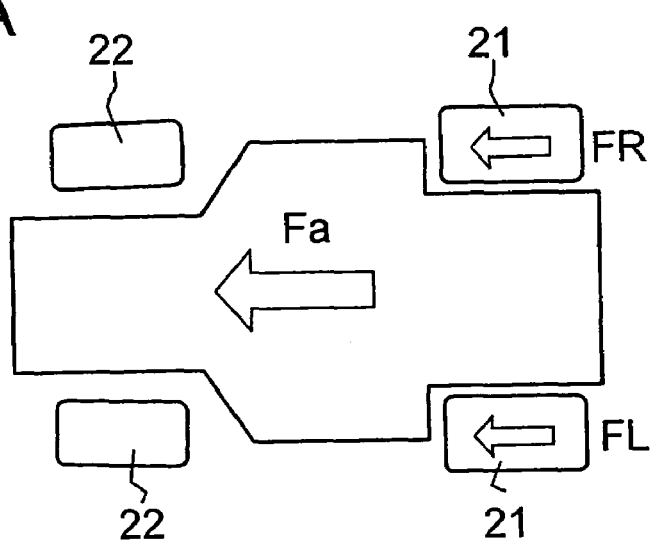
FIGS. 5A to 5C are views each showing a mutual relation between a driving force of a rear wheel, a traveling direction, and a steering direction of a front wheel.
Figure 5B:
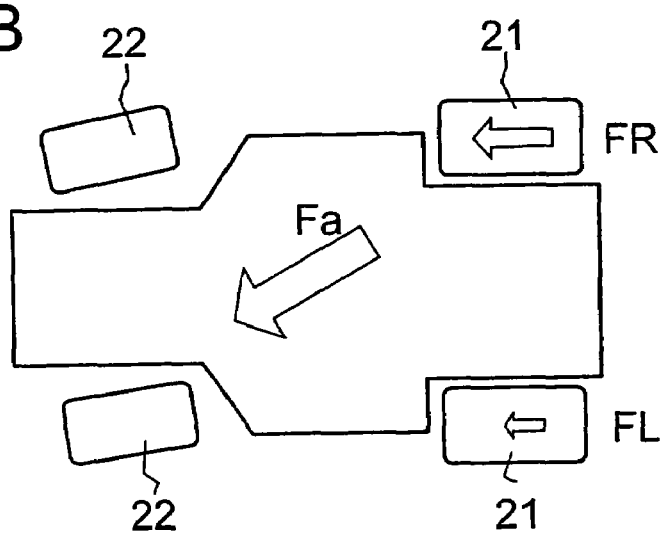
Figure 5C:
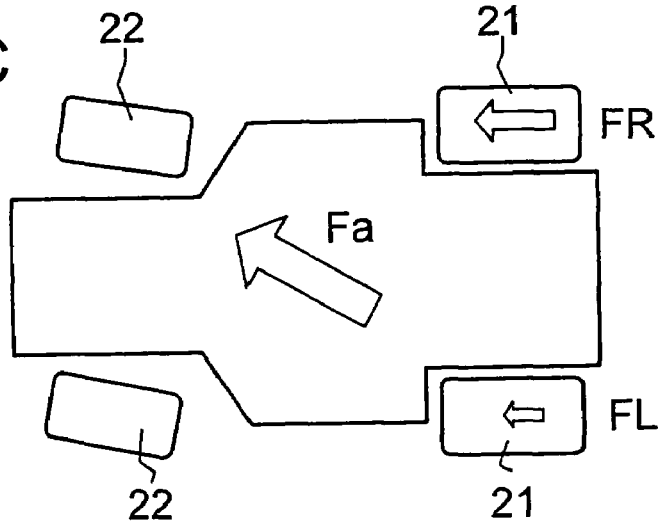

FIGS. 5A to 5C show relations of driving forces FR and FL of the rear wheels 21, a traveling direction Fa of the automobile model 2 and a steering direction of the front wheel 22. FIG. 5A shows a straight-ahead driving state in which the numbers of rotations of the left rear and right wheels 21 are equal to each other. In this state, the driving forces FR and FL are equal to each other and the traveling direction Fa of the automobile model 2 accords with the longitudinal direction of the automobile model 2, so that the front wheels 22 are oriented straightly forward. Next, when a speed of the right rear wheel 21 becomes higher than that of the left rear wheel 21 and the driving force FR becomes greater than the driving force FL as shown in FIG. 5B, the traveling direction Fa is inclined leftward. With this, the front wheels 22 are also steered leftward. However, even if the driving forces FR and FL are generated as in the same manner as that shown in FIG. 5B, in a state shown in FIG. 5C where the rear wheel 21 slips and the traveling direction Fa is inclined in a direction of an inertial force applied to the model 2, i.e., in a drift running state, the front wheel 22 receives an influence of the traveling direction Fa and is inclined toward the traveling direction Fa. Therefore, a state in which a counter steer is performed during the drift traveling is naturally reproduced without any control, and the reality of the automobile model 2 is enhanced.

As an angle expressing a mounting state of the front wheel 22, there exists, in addition to the caster angle, a tow angle β (FIG. 2) defined as an angle formed between a center line CL of the front wheel 22 and the traveling direction when the front wheels 22 are in the straight-ahead driving state, and a camber angle γ (FIG. 3) defined as an angle formed between the center line CL of the front wheel 22 and the vertical line VL when the automobile model 2 is viewed from front. Although these angles β and γ are not especially limited in the present invention, the tow angle β can be set in a range of ±1.0° including the neutral state (state in which the center line CL and the traveling direction at the time of straight running match each other), and the camber angle γ can be set in a range of ±1.50° including the neutral state (state in which the center line CL and the vertical line VL match each other). However, the tow angle β and the camber angle γ are set equal to each other for the left and right front wheels 22. The front wheels 22 can be inclined laterally around the contact position between the rod 32 and the supporting section 35*a*, but the camber angle γ is an angle which is measured in a state in which the front wheels 22 are not inclined, i.e., in which the chassis 23 is placed on a horizontal plane.

Although the automobile model 2 is shown as a passenger vehicle in FIG. 1, the automobile model of the present invention is not limited to the passenger vehicle, and the invention may be applied to various vehicles. Especially when a vehicle body is small like a Formula racing car and sufficient part-mounting space cannot be secured around the steered wheels, the present invention can preferably be used. The driven wheels and the steered wheels are not limited to the pair of left and right wheels, and two or more pairs of wheels may be provided. The steered wheel-supporting mechanism is not limited to that illustrated in the drawings, and various mechanism used for supporting the steered wheels such that the steered wheels can be steered may be used as the steered wheel-supporting mechanism in various models. Although the rear wheels are driven by the motor, the present invention can also be applied to an automobile model in which the front wheels are driven and the rear wheels are steered wheels.

As explained above, according to the present invention, since the steered wheels are naturally steered in the turning direction by a reaction force received from the ground-contact surface while a caster angle in a so-called positive direction is set in the steering axis, it is possible to apply the resiliency in the straight-ahead driving state to the steered wheels which are being turned and to suppress the excessive turning motion of the steered wheels, thereby stabilizing the attitude of the steered wheels during the turning motion. Further, since the left and right steered wheels are associated with each other so as to be steered in the same direction in an interlocked manner, there is no adverse possibility that the steered wheels are steered in the different directions from each other and the traveling direction of the automobile model is disturbed. Accordingly, even if the turning motion is carried out by the speed difference between the driven wheels, it is possible to realize the turning motion stably by naturally steering the steered wheels in the traveling direction without providing a steering driving source.

What is claimed is:

1. An automobile model comprising:
a pair of left and right driven wheels which are independently driven by different driving sources;
a pair of left and right steered wheels; and
a steered wheel-supporting mechanism which supports the steered wheels such that each steered wheel is adapted to turn around a predetermined steering axis and such that the steered wheels are adapted to turn only in the same direction in association with each other,
wherein the predetermined steering axis is fixedly inclined with respect to a vertical direction such that an upper portion of the steering axis is located rearward of a lower portion of the steering axis in a traveling direction, and
wherein the steered wheel-supporting mechanism is further configured such that, when a speed difference is generated between the driven wheels to turn the automobile model in a turning direction, the steered wheels are naturally steered in the turning direction without any additional steering driving force by a reaction force received from a ground-contact surface.

2. The automobile model according to claim 1, wherein an inclination angle of the steering axis with respect to the vertical direction is set in a range of 20° to 40°.

3. The automobile model according to claim 1, wherein the steered wheel-supporting mechanism supports the steered wheels such that center lines of the steered wheels as viewed from directly above in a straight-ahead driving state are inclined with respect to the traveling direction.

4. The automobile model according to claim 1, wherein the steered wheel-supporting mechanism supports the steered wheels such that center lines of the steered wheel as viewed from front in the traveling direction in a straight-ahead driving state are inclined with respect to the vertical direction.

5. The automobile model according to claim 1, wherein the steered wheel-supporting mechanism supports the steered wheels such that the left and right steered wheels are adapted to incline in the same direction in association with each other as viewed from front in the traveling direction.

6. The automobile model according to claim 3, wherein the steered wheel-supporting mechanism supports the steered wheels such that center lines of the steered wheel as viewed from front in the traveling direction in a straight-ahead driving state are inclined with respect to the vertical direction.

7. The automobile model according to claim 6, wherein the steered wheel-supporting mechanism supports the steered wheels such that the left and right steered wheels can incline in the same direction in association with each other as viewed from front in the traveling direction.

8. The automobile model according to claim 1, wherein when the steered wheels are naturally steered in the turning direction, a restorative force is generated that urges the wheels to return to a straight-ahead direction.

* * * * *